US005676531A

United States Patent [19]

Muscarella et al.

[11] Patent Number: 5,676,531

[45] Date of Patent: Oct. 14, 1997

[54] AUTOCLAVABLE PUMP HEAD ASSEMBLY

[75] Inventors: Stephen B. Muscarella, Geneseo, N.Y.; Robert Kenneth Pfleger, Port Charlotte, Fla.; Philip T. Pascoe, Rochester, N.Y.

[73] Assignee: Pulsafeeder, Inc., Rochester, N.Y.

[21] Appl. No.: 627,906

[22] Filed: Mar. 21, 1996

[51] Int. Cl.[6] ..... F04B 17/00

[52] U.S. Cl. ..... 417/413.1; 417/568; 92/98 R

[58] Field of Search ..... 417/412, 413.1, 417/567, 568, 900; 92/98 R, 99

[56] References Cited

U.S. PATENT DOCUMENTS

| | | | |
|---|---|---|---|
| 2,254,495 | 9/1941 | Randolph et al. | 417/413.1 |
| 4,573,885 | 3/1986 | Petersen | 417/395 |
| 4,607,627 | 8/1986 | Leber et al. | 417/413.1 |
| 4,639,245 | 1/1987 | Pastrone et al. | 417/413.1 |
| 4,836,418 | 6/1989 | Dinslage | 222/105 |
| 5,039,349 | 8/1991 | Schoeppel | 134/26 |
| 5,540,568 | 7/1996 | Rosen et al. | 417/395 |

FOREIGN PATENT DOCUMENTS

| | | | |
|---|---|---|---|
| 8110871 | 7/1983 | Japan | 417/413.1 |

*Primary Examiner*—Charles G. Freay
*Attorney, Agent, or Firm*—Hill, Steadman & Simpson

[57] ABSTRACT

A new and improved liquid metering pump for use in pumping sterile fluids and foodstuffs includes a separable autoclavable pump head assembly. The diaphragm-containing pump head may be preassembled as a unit and sterilized to provide a pump head having sterile product contact surfaces. The pre-sterilized pump head may be mounted and connected to an electronic solenoid metering pump and used for delivering fluids in food preparation, medical and pharmaceutical applications.

12 Claims, 4 Drawing Sheets

AUTOCLAVABLE PUMP HEAD ASSEMBLY

BACKGROUND OF THE INVENTION

The present invention generally relates to liquid metering pumps for delivering controlled amounts of a liquid from one vessel to another, or from a source of supply to a process stream. More particularly, it relates to a new and improved autoclavable pump head assembly for use with a metering pump which permits the metering pump to be used in metering liquid foodstuffs and sterile fluids in food preparation and medical or pharmaceutical processes.

Diaphragm metering pumps are known and used for transferring fluids from one place to another. Generally, diaphragm pumps include a pumping head area including a product chamber bounded on one side by a displaceable diaphragm member. The inlet and exit to the product chamber are provided with one-way check valves. As the diaphragm is displaced away from the product chamber, the exit check valve closes under reduced pressure, the inlet check valve opens and fluid is drawn into the product chamber. Thereafter, as the diaphragm is displaced toward the product side, pressure increases on the fluid in the product chamber, closing the inlet check valve, opening the outlet check valve and forcing fluid in the product chamber out of the exit. In continuous operation, a diaphragm pump pumps fluid through the product side in a pulsed manner.

Diaphragm displacements may be achieved with a mechanical drive system or an hydraulic drive system. An example of a mechanical drive is a solenoid pump. In a solenoid pump, a diaphragm actuator rod is secured at one end to the diaphragm, and at its opposed end is connected to a solenoid actuator. The electrically- or electronically-controlled solenoid is effective to cause reciprocal linear movement of the actuator and diaphragm actuator rod, thereby causing displacements of the diaphragm directly.

Many liquid metering applications involve the pumping and handling of special fluids which require that sterile procedures and/or equipment be used. Illustrative examples include food preparation wherein, for example, edible cooking oils are delivered to a process stream for incorporation into a processed food product. In pharmaceutical preparations, sterile fluid components may be delivered from a supply to a reactor or product stream. In medical and biological experiments, controlled amounts of sterile culture media may need to be delivered to or replenished in a tray of cell or tissue cultures. Foodstuffs or sterile fluids may need to be delivered in canning, bottling or other packaging operations. All product fluid contact surfaces of metering pumps for these pumping operations should be or by law are required to be sterilized.

The pump heads for liquid metering pumps comprise a multitude of parts which are assembled together and mounted to the front end of the metering pump. Sterilized or sterilizable pump heads for liquid metering pumps are generally not known. Even if the separate parts are individually sterilized, handling is required for assembly which renders the product contact surfaces non-sterile. As a result, liquid metering pumps have not been used for these potential pumping application areas.

SUMMARY OF THE INVENTION

In order to overcome the disadvantages of prior art metering pumps, it is an object of the present invention to provide a new and improved autoclavable pump head assembly which may be preassembled and sterilized as an assembled unit for use with a liquid metering pump.

It is another object of the present invention to provide a new and improved liquid metering pump having sterilized fluid contact surfaces which may be employed in sterile fluid and liquid foodstuffs pumping applications.

In accordance with these and other objects, the present invention provides a new and improved autoclavable pump head assembly. In an embodiment, the autoclavable pump head assembly comprises a pump head body. The pump head body includes a front end, an opposed rear end and a one-way product flow passageway defined between a product inlet and a product outlet through which product is pumped in a pulsed manner. A rear end opening is provided in the rear end of the pump head body which communicates with the product flow passageway. A diaphragm member is disposed against the rear end of pump head body covering the rear opening. A retainer member is releasably secured to the pump head body and maintains the diaphragm in fluid-tight sealed engagement with the pump head body. The pump head assembly is sterilizable or autoclavable as a preassembled unit to provide a sterilized pump head in which all of the product contacting surfaces of the pump head body and diaphragm are sterilized. The new and improved autoclavable pump head assembly, after autoclaving or sterilization, may be operatively connected to a liquid metering pump to provide a liquid metering pump which may be used to pump liquid foodstuffs and/or sterile fluids.

In an embodiment, the present invention provides a new and improved liquid metering pump modified or adapted for pumping sterile fluids and/or foodstuffs. The liquid metering pump comprises an electrically controlled metering pump body having a reciprocally movable actuator rod projecting therefrom. A pre-sterilized autoclavable pump head assembly is mounted to the pump body. A rearward facing surface of the diaphragm is operatively connected with the actuator rod of the pump body so that reciprocal movement of the actuator rod causes pumping displacements of the diaphragm within the pump head assembly. In a preferred embodiment, the electrically controlled metering pump body comprises a solenoid-type liquid metering pump.

In accordance with the invention, liquid metering pumps are provided with a new and improved autoclavable pump head assembly so that liquid metering pumps may now be used for applications involving pumping and delivery of sterile fluids and foodstuffs.

Other objects and advantages of the present invention will be apparent from the following Detailed Description of the Preferred Embodiments and the Drawings in which:

DETAILED DESCRIPTION OF THE PREFERRED EMBODIMENTS

Figure 1:
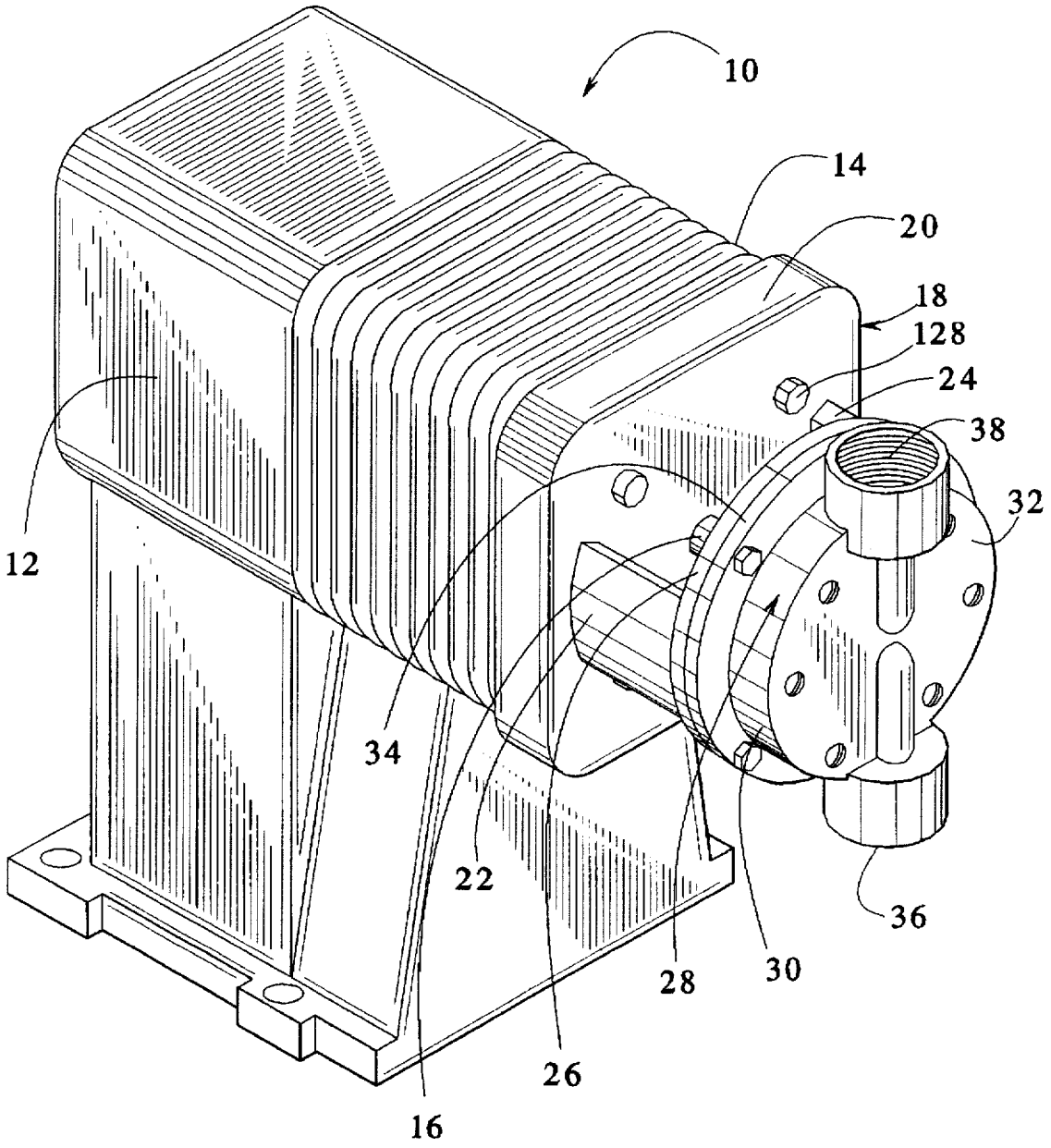
FIG. 1 is a perspective view of a new and improved electrically controlled liquid metering pump in accordance with the present invention including the new and improved autoclavable pump head assembly shown fully mounted and assembled and ready for use.

Referring now to FIG. 1, a new and improved liquid metering pump adapted for pumping sterile fluids, generally referred to by reference number 10, is shown. Liquid metering pump 10 includes a pump housing 12 enclosing an electrically- or electronically-controlled solenoid actuator system having a front end 14 with a solenoid actuator rod 16 projecting therefrom. A generally H-shaped mounting bracket 18 including a pump mounting plate 20, a pair of spacer arms 22 and 24, and a head mounting plate 26 is mounted on the front end 14 of pump housing 12. The new and improved autoclavable pump head assembly 28 is shown mounted to head mounting plate 26 of mounting bracket 18.

Electronic solenoid liquid metering pumps for use as the pump base are well known to those skilled in this art and several models are commercially available from a number of sources. An excellent liquid metering pump for use herein is commercially available under the PULSAtron® Series tradename available from Pulsafeeder, Inc., Rochester, N.Y.

Figure 2:
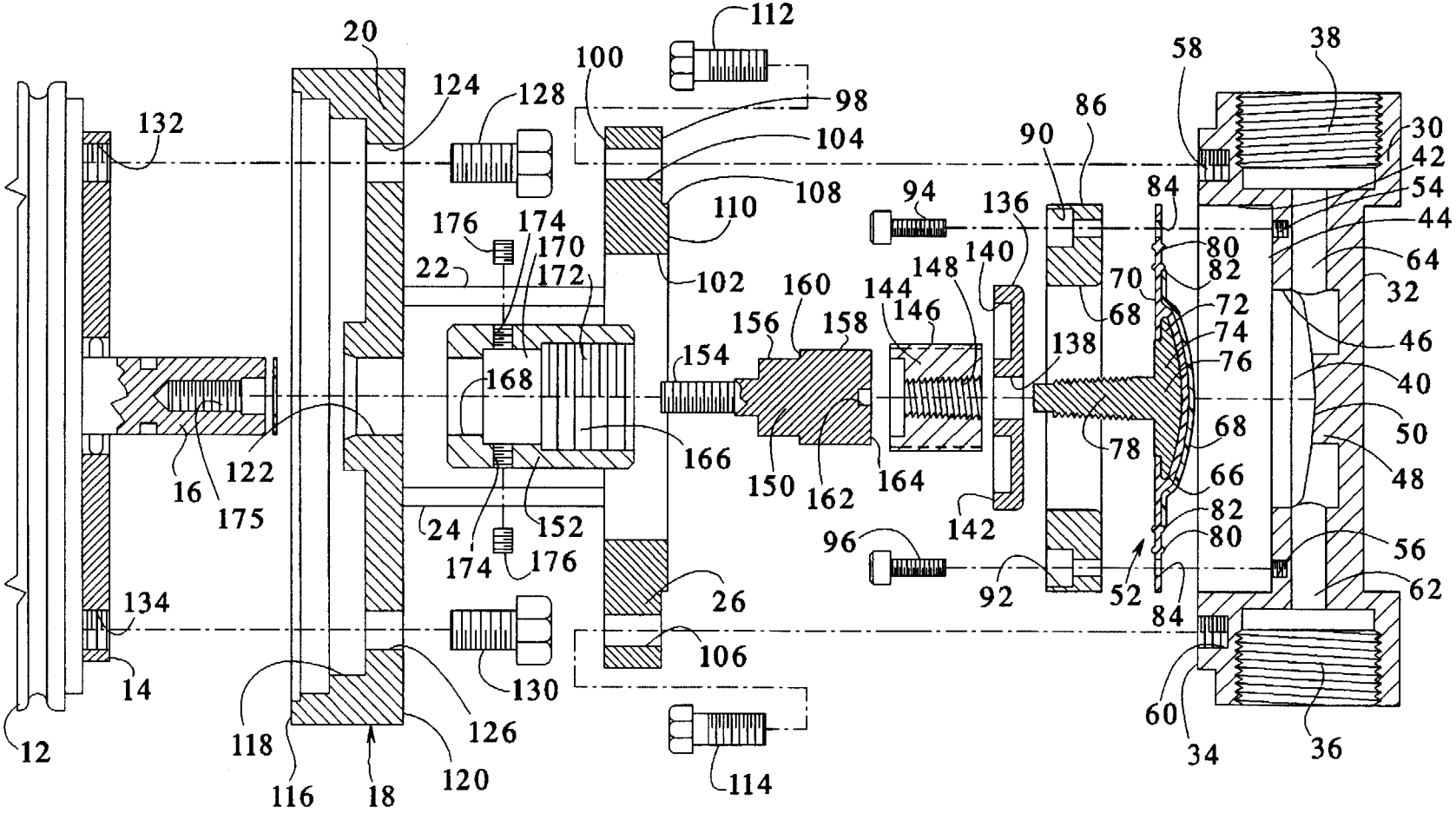
FIG. 2 is an elevated, exploded cross-sectional view of the front end of the new and improved liquid metering pump and autoclavable pump head assembly in accordance with the present invention.
Figure 3:
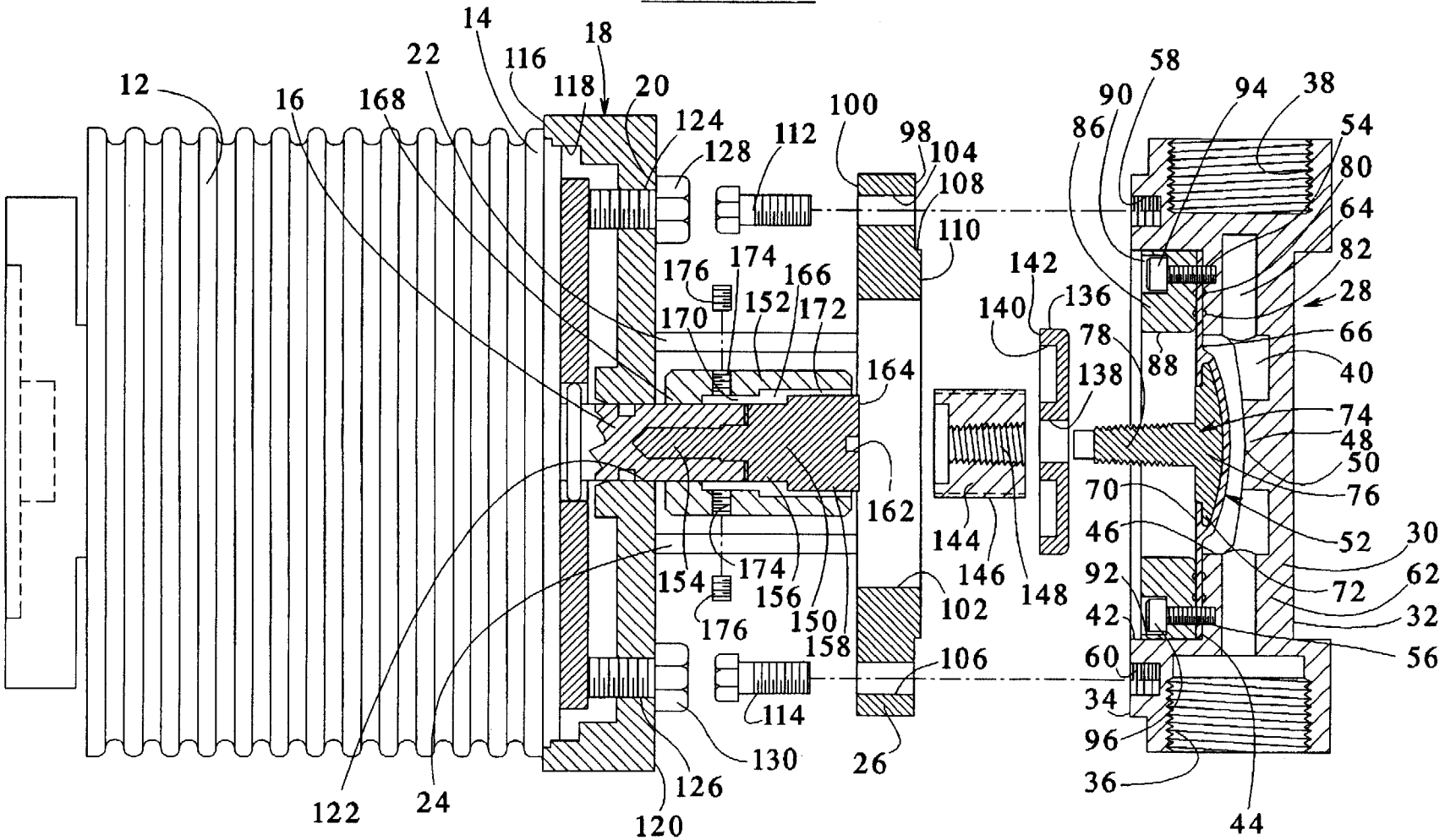
FIG. 3 is an elevated cross-sectional view of the front end of the new and improved liquid metering pump of the present invention shown in partly assembled condition.
Figure 4:
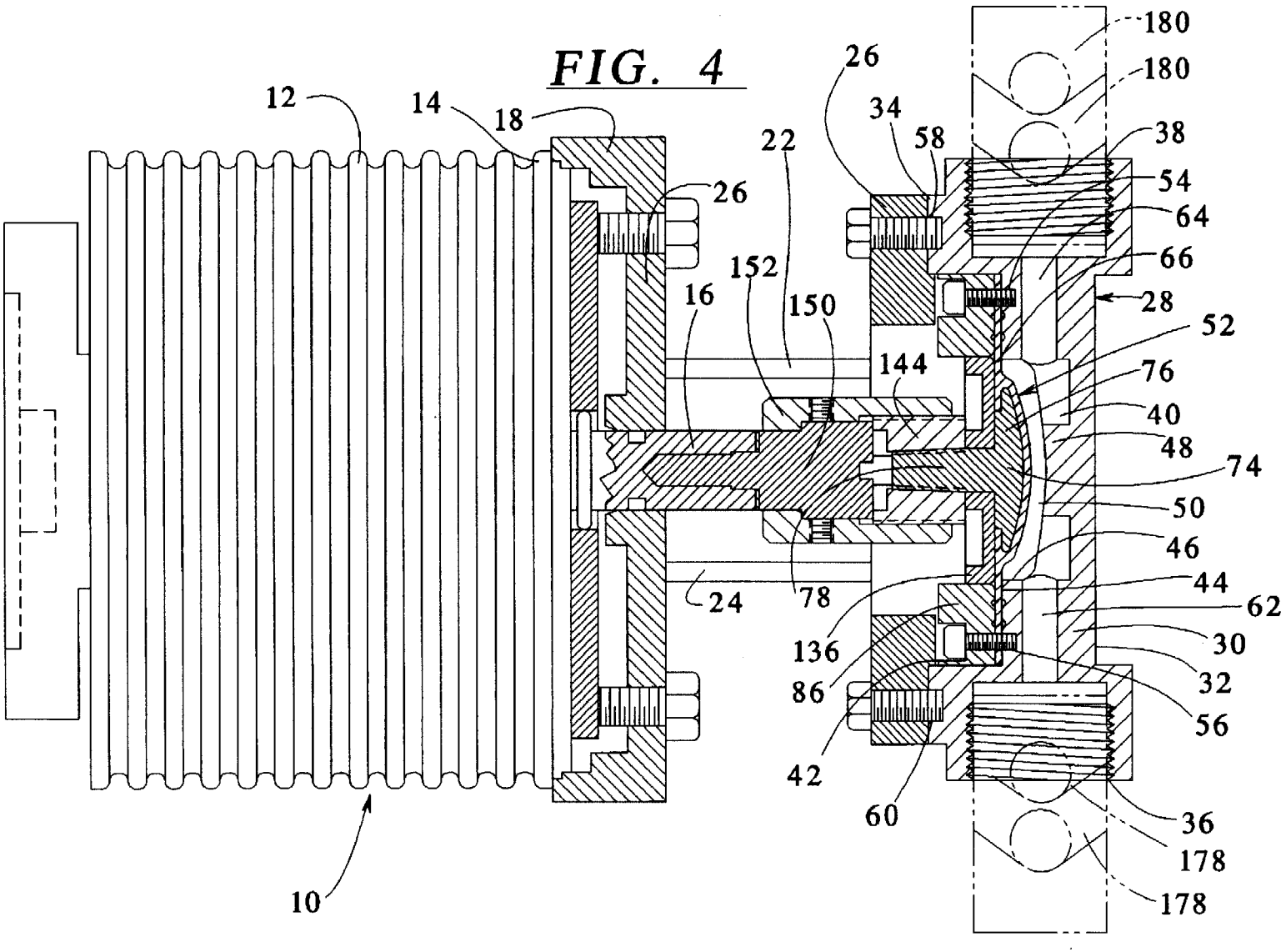
FIG. 4 is an elevated cross-sectional view of the front end of the new and improved liquid metering pump of the present invention shown in fully assembled form.

In greater detail, and referring now to FIGS. 2–4, autoclavable pump head assembly 28 comprises a pump head body 30 including a front end 32, an opposed rear end 34, a lower threaded product inlet opening 36 and an upper threaded product discharge opening 38. A product chamber 40 is defined in the interior of head body 30. Rear end 34 includes a cylindrical recess 42 defining an inner bearing surface 44. A rear opening 46 is provided in bearing surface 44 which communicates with product chamber 40. In the preferred embodiment shown in FIGS. 2–4, a raised platform 48 extends inwardly from front end 32 into product chamber 40 to define a positive stop surface 50 for limiting forward displacements of the diaphragm assembly 52 into product chamber 40. Pump head body 30 further includes a plurality of threaded recesses 54 and 56 in bearing surface 44, as well as, a plurality of pass through mounting apertures 58 and 60. A product inlet passageway 62 extends between inlet opening 36 and product chamber 40. A product discharge passageway 64 extends between discharge opening 38 and product chamber 40.

Autoclavable pump head assembly 28 further comprises diaphragm assembly 52. Diaphragm assembly 52 includes a resilient flexible diaphragm member 66 having a generally circular or disk shaped configuration. Diaphragm member 66 has a forward major surface 68 and an opposed rearward surface 70, including a centrally disposed pocket portion 72 defined therein. Diaphragm assembly 52 further includes a generally T-shaped diaphragm insert member 74 having a rounded head portion 76 and a rearwardly extending threaded shaft portion 78. Head portion 76 is received in pocket portion 72 and secured thereto, preferably by a suitable adhesive. In accordance with the preferred embodiment, diaphragm member 66 further includes a pair of radially spaced annular ribs 80, 82 for redundant sealing. A plurality of through-hole apertures 84 extend through a peripheral edge portion of diaphragm 66 to positively position diaphragm assembly 52 with respect to cylindrical recess 42 in pump head body 30 for assembly.

Autoclavable pump head assembly 28 additionally comprises an annular retainer member 86 including a large central opening 88 and a plurality of tapped or stepped through-hole mounting apertures 90, 92 extending therethrough.

Autoclavable pump head assembly 28 is assembled to form an autoclavable preassembled unit by inserting diaphragm assembly 52 into cylindrical recess 42 so that front surface 68 is disposed in abutting face-to-face contact with bearing surface 44 and so that pocket portion 72 is generally received within rear opening 46. Through-holes 84 are disposed in alignment or registration with threaded recesses 54 and 56 in housing surface 44. Retainer member 86 is telescopically received in cylindrical recess 42 so that through-hole apertures 90 and 92 are aligned and disposed in registration with diaphragm through-holes 84 and threaded recesses 54 and 56, respectively. Threaded mounting screws 94, 96 are inserted through apertures 90 and 84 into threaded recess 54 and through apertures 92 and 84 into threaded recess 56, respectively. As screws 94 and 96 are turned to their fully threadedly engaged position in threaded recesses 54 and 56, diaphragm assembly 52 and ribs 80, 82 are compressed between retainer member 86 and bearing surface 44 so that diaphragm assembly 52 is disposed in abutting fluid-tight sealed engagement with bearing surface 44.

As is best shown in the right-hand portion of FIG. 3, the assembled autoclavable pump head assembly 28 defines a unitary integral structure including an open-ended, but otherwise closed, product flow passageway extending from product inlet 36, along inlet passageway 62, through product chamber 40, along outlet or discharge passageway 64, to discharge opening 38. The autoclavable assembly 28 may be preassembled and sterilized in any autoclave or by other sterilization procedures. For example, assembly 28 may be placed in an autoclave or steam sterilizer unit and sterilized under conditions of elevated temperature for a time sufficient to ensure that all fluid contact surfaces of the pump head body 30 and diaphragm assembly 52 are sterilized and pathogen-free. Elevated temperatures may range from 100° to 250° C., and the duration of treatment may vary depending upon the temperature employed. For example, at temperatures at the lower end of the above-mentioned temperature range, longer treatment periods of from at least about 0.5 to several hours may be required to provide a desired level of sterilization. At higher autoclave or processing temperatures, e.g., from 200° to 250° C. or higher, treatment times of from about 10 minutes to one hour may be sufficient. The exact exposure times and temperatures to achieve a desired level of decontamination or sterilization is well within the skill of those knowledgeable in the art.

In accordance with the present invention, the new and improved preassembled and pre-sterilized pump head assembly 28 may be operatively connected to a liquid metering pump 12 to pump sterile fluids or fluid foodstuffs. Pump head assembly 28 is operatively connected by means for mounting the assembly 28 to a pump housing 12 and means for connecting the shaft portion 78 of diaphragm insert 74 to the projecting solenoid actuator rod 16.

Referring again to FIGS. 2–4, a mounting bracket 18 is provided for mounting the pump head assembly 28 to the pump housing 12. Mounting bracket 18 includes a pump mounting plate 20, a parallel spaced apart head mounting plate 26 and a pair of spacer arms 22, 24 extending between and interconnecting pump mounting plate 20 and head mounting plate 26. In the preferred embodiment shown in FIGS. 1–4, head mounting plate 26 has a generally thin cylindrical configuration including a front end 98, an opposed rear end 100, a large central aperture 102 and a plurality of peripheral threaded mounting apertures 104, 106. An inwardly directed peripheral shoulder 108 is provided in front end 98, thereby defining a raised annular platform 110 projecting forwardly about the central aperture 102. Platform 110 is configured to be telescopically received in rear recess 42 of pump head body 30 to facilitate proper mounting alignment of the pump head assembly 28 to head mounting plate 26. Pump head assembly 28 is securely mounted to head mounting plate 26 by threaded mounting screws 112, 114 which are received through mounting apertures 58, 60 into threaded engagement with threaded apertures 104, 106, respectively, provided in head mounting plate 26.

Pump mounting plate 20, as shown, has a generally rectangular configuration including a rear end 116 having a double-stepped recess 118, and an opposed front end 120 with a central rod receiving aperture 122. A plurality of through-hole mounting apertures 124, 126 extend through front end 120 spaced from aperture 122. Pump mounting plate 20 is positioned so that the rear end 116 is received against the front end 14 of pump housing 12 with solenoid actuator rod 16 telescopically received through rod receiving aperture 122. Mounting bracket 18 is mounted to pump housing 12 by threaded mounting bolts 128, 130 inserted through mounting apertures 124 and 126 and threadedly engaged in threaded recesses 132, 134 provided in front end 14 of pump housing 12.

After mounting, the diaphragm assembly 52 in autoclavable pump head assembly 28 is operatively connected to solenoid actuator rod 16 so that reciprocal movements of actuator rod 16 provide reciprocal pumping displacements of the diaphragm member 66 toward and away from the product chamber 40 in pump head body 30.

More particularly, and referring to the preferred embodiment depicted in FIGS. 2–4, a deflection plate 136 is optionally but preferably provided having a generally cylindrical configuration including a central aperture 138 and an annular recess 140 defined in a rearward side 142 thereof. Deflection plate 136 is placed in the central opening 88 of retainer member 86 with the shaft portion 78 of diaphragm insert 74 telescopically received in central aperture 138 until a front surface of deflection plate 136 abuts the rear surface 70 of diaphragm member 66. Deflection plate 136 is provided to limit rearward deflection of the diaphragm member 66 by providing a limiting support surface. Deflection plate 136 may have a solid front surface.

A generally cylindrical threaded adapter nut 144 is provided including a series of external peripheral threads 146 along the outer surface thereof and a threaded central bore 148 extending therethrough. Adapter nut 144 is rotatably and threadedly engaged on threaded shaft portion 74 of diaphragm insert 74 and in fully advanced and threaded condition maintains the deflection plate 136 in abutting face-to-face contact with rear surface 70 of diaphragm member 66.

As shown in FIGS. 2–4, coupling between the diaphragm assembly 52 and solenoid actuator rod 16 is further provided by a solenoid adapter 150 and a knurled rotatable coupling nut 152. Solenoid adapter 150 has a stepped cylindrical configuration including a rearwardly extending threaded shaft portion 154, an intermediate portion 156 having a diametrical dimension larger than the shaft portion 154 and a forward portion 158 having a diametrical dimension larger than that of the intermediate portion 156 and defining a bearing surface 160. A tool receiving slot 162 may be provided in the front end surface 164 of solenoid adapter 150.

Rotatable coupling nut 152 has a generally cylindrical configuration and is preferably provided with a knurled exterior surface. Coupling nut 152 includes a stepped central bore 166 including a rear opening 168 and intermediate portion 170 and a larger threaded front end portion 172. A pair of threaded apertures 174 are preferably provided through the sidewall of coupling nut 152 as shown.

Coupling nut 152 is inserted over solenoid actuator rod 16 so that the front end of rod 16 is telescopically received through the rear opening 168. Solenoid adapter 150 is telescopically received in front portion 172 and rotated to threadingly engage shaft portion 154 in a threaded bore 175 provided in the front end of actuator rod 16 as shown in FIG. 3. The rear opening 168 in coupling nut is dimensioned to rotatably, slidably ride over the surfaces of actuator rod 16 and intermediate portion 156 of solenoid adapter 150. The intermediate portion 170 of bore 166 in coupling nut 152 is dimensioned to closely telescopically receive the forward portion 158 of solenoid adapter 150. The wall surfaces around rear opening 168 bear against bearing surface 160 on solenoid adapter 150. Coupling nut 152 is free to rotate about solenoid rod 16 and intermediate portion 156 and can slide laterally therealong between pump mounting plate 20 and bearing surface 160.

Final coupling is achieved by mounting the autoclavable pump head assembly 28 with the deflection plate 136 and adapter nut 140 fully installed onto head mounting plate 26. Thereafter, coupling nut 152 may be moved forwardly until the threaded front portion 172 engages the external threaded surface 146 on adapter nut 144. Rotation of coupling nut 152 to a fully seated position over adapter nut 144 interconnects the diaphragm assembly 52 to the solenoid actuator rod 16. Set screws 176 may be positioned in threaded apertures 174 to rotatably lock the coupling nut 152.

Assembly of pump 10 is achieved by mounting pump mounting plate 20 to pump front end 14. The coupling nut 152 and solenoid adapter 150 are installed on the solenoid actuator rod 16. The deflection plate 136 and adapter nut 144 are installed on shaft portion 78 of a preassembled and pre-sterilized pump head assembly 28. Thereafter, pump head assembly 28 is mounted to head mounting plate 26 and coupling nut 152 is rotatably advanced over adapter nut 44 and locked with set screws 174. Clearance provided between spacer arms 22 and 24 provides adequate access to coupling nut 152 so that it can be moved and rotated to the final locked position.

As shown in phantom in FIG. 4, threaded one-way ball check valve assemblies 178, 180 are threadedly engaged in lower inlet opening 36 and upper discharge opening 38, respectively. Valve assemblies 178 and 180 may be installed in the pump head assembly 28 prior to autoclaving or they may be separately sterilized and added later. Sterile connect tubing, not shown, may be connected to the inlet valve assembly 178 and outlet valve assembly 18 to provide a sterile flow path into and away from pump head assembly 28. In operation, forward displacement of the diaphragm assembly 66 into product chamber 40 increases pressure within chamber 40, closing the inlet valves 178, opening outlet valves 180, and forcing fluid present in chamber 40 out through discharge opening 38. On the return or suction stroke of the pump, the diaphragm assembly 52 moves rearwardly away from product chamber 40, reducing the pressure, thereby closing the outlet valves 180, opening inlet valves 178 and drawing fluid into the product chamber 40, for discharge on the next pump stroke in accordance with well-known methods.

The new and improved autoclavable pump head assembly may comprise conventional metal or thermoplastic materials having sufficient dimensional stability to withstand elevated temperatures of autoclaving or sterilization processing. Pump head body 30 and retainer member 86 may comprise casted metal or machined metal such as aluminum alloy, stainless steel or other metal materials. Pump head body 30 may comprise a thermoplastic polymer selected from polymers and copolymers derived from ethylenically unsaturated monomers, polyamides, polyesters, polycarbonates or other engineering thermoplastics employed in molding shaped articles. Preferably, pump head body 30 is a unitary thermoplastic molding made from glass-filled polypropylene, polyvinyl chloride, styrene-acrylonitrile copolymer or polyvinylidene fluoride. Diaphragm member 66 may comprise polytetrafluoroethylene (e.g., Teflon®) materials. Preferably, a Teflon® faced elastomer diaphragm member 66 is used optionally including fiber or fabric reinforcement. The diaphragm insert 74 may be metal, such as a brass alloy. The materials may also include conventional additives including pigments, stabilizers and the like added in conventional amounts.

The new and improved autoclavable pump head assembly 28 and pump 10 modified to handle sterile fluids and foodstuffs now permits electronic liquid metering pumps to be employed in a broader range of pumping applications.

Although the present invention has been described with reference to certain preferred embodiments, modifications or changes may be made therein by those skilled in the art without departing from the scope and spirit of the present invention as defined by the appended claims.

What is claimed is:

1. A liquid metering pump adapted for pumping sterile fluids or foodstuffs comprising:

an electrically controlled metering pump body having a reciprocally movable actuator rod projecting therefrom;

a pre-sterilizable pump head assembly mounted to said pump body, said pump head assembly including: a pump head body having a front end, an opposed rear end, a one-way product flow passageway defined between a product inlet and a product outlet through which a sterile fluid or foodstuff product is pumped in a pulsed manner, said pump head body further including a rear opening in the rear end communicating with the product flow passageway, a diaphragm member including a forward major surface, an opposed rearward major surface and a shaft projection extending rearwardly from the rearward major surface, the diaphragm member being disposed against the rear end so that the forward major surface covers the rear opening, and a retainer member releasably secured to the rear end and maintaining the diaphragm in fluid-tight sealed engagement with the pump head body, said pump head assembly being preassembled as a unit so that fluid contacting surfaces of said pump head body and diaphragm may be pre-sterilized as an assembled unit; and means for releasably connecting the shaft projection of the diaphragm member to said actuator rod so that reciprocal movements of the pump actuator rod cause pumping displacements of the diaphragm.

2. A liquid metering pump as defined in claim 1, wherein said pump head body comprises metal.

3. A liquid metering pump as defined in claim 1, wherein said pump head body comprises stainless steel.

4. A liquid metering pump as defined in claim 1, wherein said pump head body comprises a polymer material.

5. A liquid metering pump as defined in claim 4, wherein said polymeric material is selected from the group consisting of homopolymers and copolymers derived from ethylenically unsaturated monomers, polyamides, polyesters and polycarbonates.

6. A liquid metering pump as defined in claim 1, wherein said pump head body comprises a unitary thermoplastic polymer molding.

7. A liquid metering pump as defined in claim 6, wherein said unitary thermoplastic polymer molding comprises a thermoplastic polymer selected from the group consisting of glass-filled polypropylene, polyvinyl chloride, styrene-acrylonitrile copolymer and polyvinylidine fluoride.

8. A liquid metering pump as defined in claim 1, wherein said diaphragm member comprises polytetrafluoroethylene.

9. A liquid metering pump as defined in claim 1, wherein said diaphragm member comprises a polytetrafluoroethylene-faced elastomer.

10. A liquid metering pump as defined in claim 1, further comprising a mounting bracket mounted to a front end of the pump body including a pump head mounting plate spaced from the front end of the pump body and said pump head assembly is mounted to said pump head mounting plate.

11. A liquid metering pump as defined in claim 1, wherein said electrically controlled metering pump body comprises an electronically controlled solenoid pump.

12. A liquid metering pump as defined in claim 1, wherein the shaft projection has a threaded end portion and the means for releasably connecting the shaft projection to the actuator rod comprises a threaded coupling nut rotatably mounted on the actuator rod which is threadedly engaged with the threaded end portion of the shaft projection.

* * * * *